US008117890B1

(12) United States Patent
Durmeyer et al.

(10) Patent No.: US 8,117,890 B1
(45) Date of Patent: Feb. 21, 2012

(54) AUTOMATIC OPTIMIZED CALIBRATION FOR A MARINE PROPULSION SYSTEM WITH MULTIPLE DRIVE UNITS

(75) Inventors: Michael F. Durmeyer, Eden, WI (US); Jason S. Arbuckle, Horicon, WI (US)

(73) Assignee: Brunswick Corporation, Lake Forest, IL (US)

( * ) Notice: Subject to any disclaimer, the term of this patent is extended or adjusted under 35 U.S.C. 154(b) by 293 days.

(21) Appl. No.: 12/565,923

(22) Filed: Sep. 24, 2009

(51) Int. Cl.
*G01C 17/38* (2006.01)

(52) U.S. Cl. ..... 73/1.75

(58) Field of Classification Search ..... None
See application file for complete search history.

(56) References Cited

U.S. PATENT DOCUMENTS

| | | | |
|---|---|---|---|
| 3,899,992 | A | 8/1975 | Fuller |
| 3,972,224 | A | 8/1976 | Ingram |
| 4,939,660 | A | 7/1990 | Newman et al. |
| 5,785,562 | A | 7/1998 | Nestvall |
| 5,910,032 | A | 6/1999 | Gruenwald et al. |
| 6,234,853 | B1 | 5/2001 | Lanyi et al. |
| 6,458,003 | B1 | 10/2002 | Krueger |
| 6,885,919 | B1 | 4/2005 | Wyant et al. |
| 6,997,763 | B2 | 2/2006 | Kaji |
| 7,066,775 | B1 | 6/2006 | Seter |
| 7,131,385 | B1 | 11/2006 | Ehlers et al. |
| 7,220,157 | B2 | 5/2007 | Pettersson |
| 7,267,068 | B2 | 9/2007 | Bradley et al. |
| 7,305,928 | B2 | 12/2007 | Bradley et al. |
| 7,387,556 | B1 | 6/2008 | Davis |
| 7,389,165 | B2 | 6/2008 | Kaji |
| 7,527,538 | B2 * | 5/2009 | Mizutani ..... 440/61 S |

* cited by examiner

*Primary Examiner* — Robert R Raevis
(74) *Attorney, Agent, or Firm* — William D. Lanyi

(57) ABSTRACT

A method for calibrating the steering configuration for a marine propulsion system provides a procedure by which the steering alignment is changed by a known and symmetrical amount in order to identify and characterize the effect that such a change has on the operating efficiency of the marine vessel. Before the calibrating process is completed, the overall consistency of the vessel operation is measured to determine that the conditions are correct for the calibration procedure to commence. After analyzing the consistency of operation of the marine vessel, known and symmetrical changes, or perturbations, in the steering system are made and the effect of those changes are determined as a function of the fuel usage by the marine vessel. The effects on fuel usage are characterized as being beneficial, harmful, or negligible. In other words, the effect on the marine propulsion system resulting from the change in steering alignment is characterized as improving the fuel usage, degrading the fuel usage, or having a negligible effect on the fuel usage.

20 Claims, 5 Drawing Sheets

AUTOMATIC OPTIMIZED CALIBRATION FOR A MARINE PROPULSION SYSTEM WITH MULTIPLE DRIVE UNITS

BACKGROUND OF THE INVENTION

1. Field of the Invention

The present invention is generally related to an automatic calibration and optimization method for multiple drive marine propulsion systems and, more particularly, to a procedure that is intended to properly align the propeller shafts of the multiple drive system in such a way that the efficiency of fuel usage is maximized.

2. Description of the Related Art

Many types of known propulsion systems utilize multiple drive units to propel a marine vessel. The multiple drive units can comprise outboard motors, sterndrive units, or pod drive systems. The pod drive marine propulsion systems are most likely to benefit from the automatic calibration system of the preferred embodiments of the present invention. Although the basic concepts of the present invention can be applied to other types of marine propulsion systems, it will be described herein in conjunction with multiple drive units that are supported below the hull of a marine vessel in the manner generally described in U.S. Pat. Nos. 7,131,385 and 7,267,068. This same type of marine propulsion system is also described in U.S. Pat. Nos. 7,305,928 and 7,387,556.

When two or more marine drive units are used to propel a marine vessel, the net total thrust vector exerted on the marine vessel is the resultant of the individual thrusts provided by the multiple drive units. As a result, it is possible to exert a thrust which propels the marine vessel in a generally straight direction even though neither of the two drive units is aligned in a parallel relationship with the centerline of the marine vessel (e.g. its keel line). This occurs because two drives whose propeller shaft axes are not parallel to the keel of the marine vessel can add together, vectorally, to result in a combined thrust that is parallel to the keel line. Although this situation propels the marine vessel in a forward direction which parallel to its keel, it does so in a less than efficient manner in most cases. One of the purposes of the preferred embodiments of the present invention is to align the individual drive units so that the efficiency of their operation can be improved. One of the basic purposes of the preferred embodiments of the present invention is to position the individual drive units of the multiple drive propulsion system so that they not only result in a combined thrust that drives the marine vessel in a generally straight and consistent direction but, in addition, also minimize the fuel usage required to propel the boat.

Although the preferred embodiments of the present invention are not known to those skilled in the art, various other marine propulsion systems and steering mechanisms are known and are discussed below.

U.S. Pat. No. 3,899,992, which issued to Fuller on Aug. 19, 1975, describes a marine steering device. A propeller duct or nozzle provided with controllable passageways and modulated for the purposes of developing a controllable athwartship thrust which may be used without rudder deflection or drag arising therefrom for the purpose of making minor directional changes necessary to keep a ship on course, and when used in conjunction with a rudder, to increase steering effectiveness at high and full helm angles, with possible reduction in rudder area is described. The steering device also improves effectiveness when going astern or when maneuvering alongside with a stopped ship. The device retains the improved propulsive efficiency characteristic of a ducted propeller whilst compensating for the increase in wetted area represented by the duct or nozzle.

U.S. Pat. No. 3,972,224, which issued to Ingram on Aug. 3, 1976, describes a shaft efficiency monitoring system. It continuously provides direct readouts of horsepower and efficiency of a rotating shaft. It includes a husk assembly associated with the shaft and providing electrical signals proportional to shaft torque. It comprises a tachometer for providing electrical signals proportional to shaft rotational speed, electrical circuitry for electronically multiplying the torque signals by the RPM signals to determine shaft horsepower, and a dividing network for dividing the shaft horsepower signal into an electrical signal representing the rate of fuel consumption to provide a continuous indication of instantaneous system efficiency.

U.S. Pat. No. 4,939,660, which issued to Newman et al. on Jul. 3, 1990, discloses a fuel conserving crew system for a marine drive unit. It discloses a system for optimizing the operating efficiency of a boat by balancing fuel consumption against cruising speed and utilizes a comparison between engine speed and boat speed to effect automatic positioning of the drive unit.

U.S. Pat. No. 5,785,562, which issued to Nestvall on Jul. 28, 1998, describes a method for trimming of a boat propeller shaft and drive unit with means for performing the method. It comprises an internal combustion engine and an outboard drive driven by the engine. The engine has an engine control unit which holds the speed of the engine constant independently of the load on the engine. A flow meter continuously gives a signal, which represents the instantaneous fuel consumption to the engine control unit. A trim control unit controls the trim angle of the drive so that the lowest fuel consumption for the set engine speed is achieved.

U.S. Pat. No. 5,910,032, which issued to Gruenwald et al. on Jun. 8, 1999, discloses a marine propulsion system, incorporating a jet pump, which provides improved mass flow through the pump by utilizing an inlet opening which initially diverges to a transition point in front of an impeller and then diverges from the transition point past the impeller region to the outlet opening of the pump. Significantly increased flow rates per horsepower are achieved by reducing the normal restrictions caused by the inlet and outlet openings of known pumps.

U.S. Pat. No. 6,234,853, which issued to Lanyi et al. on May 22, 2001, discloses a simplified docking method and apparatus for a multiple engine marine vessel. The docking system is provided which utilizes the marine propulsion unit of a marine vessel, under the control of an engine control unit that receives command signals from a joystick or push button device, to respond to a maneuver command from the marine operator. The docking system does not require additional propulsion devices other than those normally used to operate the marine vessel under normal conditions.

U.S. Pat. No. 6,458,003, which issued to Krueger on Oct. 1, 2002, describes a dynamic trim of a marine propulsion system. It defines a program to control the trim position of a propulsion unit mounted on a watercraft for a desired utility mode. Also, a method and system for controlling the trim position in a given utility mode by using the defined program is described. In defining the program, a first utility mode is defined and the watercraft is operated in the defined mode as a normal operation. Multiple trim positions are selected throughout the course of operation in the defined mode.

U.S. Pat. No. 6,885,919, which issued to Wyant et al. on Apr. 26, 2005, discloses a method for controlling the operation of a marine vessel. A process is provided by which the operator of a marine vessel can invoke the operation of a computer program that investigates various alternatives that can improve the range of the marine vessel. The distance between the current location of the marine vessel and a current way point is determined and compared to a range of the marine vessel which is determined as a function of available fuel, vessel speed, fuel usage rate, and an engine speed. The computer program investigates the results that would be achieved, theoretically, from a change in engine speed. Both increases and decreases in engine speed are reviewed and additional theoretical ranges are calculated as a function of those new engine speeds.

U.S. Pat. No. 6,997,763, which issued to Kaji on Feb. 14, 2006, describes a running control device. It controls propulsion force and tilt angle of a propulsion device relative to the hull of the watercraft. The running control device also sets an optimum trim angle automatically. The running control device includes a propulsion force control section that controls the propulsion force of the propulsion device. The running control device also includes a tilt angle control section that controls the tilt angle of the propulsion device.

U.S. Pat. No. 7,066,775, which issued to Seter on Jun. 27, 2006, describes a propeller wash straitening device. It is intended for increasing the efficiency of propeller driven watercraft. An elongated outer tubular member open at each end thereof is adapted for connection to the boat or vessel to position the outer member immediately downstream of the propeller and in substantially longitudinal fixed alignment with the direction of axial thrust produced by the propeller. A plurality of elongated hollow open-ended inner tubular members is positioned in closely packed fashion within and generally co-extensive with a substantial portion of the length of the outer tubular member.

U.S. Pat. No. 7,131,385, which issued to Ehlers et al. on Nov. 7, 2006, discloses a method for braking a vessel with two marine propulsion devices. A method for controlling the movement of a marine vessel comprises steps that rotate two marine propulsion devices about their respective axes in order to increase the hydrodynamic resistance of the marine propulsion devices as they move through the water with the marine vessel. This increased resistance exerts a braking thrust on the marine vessel. Various techniques and procedures can be used to determine the absolute magnitudes of the angular magnitudes by which the marine propulsion devices are rotated.

U.S. Pat. No. 7,220,157, which issued to Pettersson on May 22, 2007, describes an arrangement and method for parallel alignment of propeller shafts and means for propeller alignment. An arrangement and method for parallel alignment of propeller shafts in a first and a second underwater housing arranged on the hull of a vessel, which are arranged to rotate around an axis of rotation which is angled in relation to the propeller shafts arranged in each underwater housing, which arrangement includes a servo motor arranged for each underwater housing, which servo motor is arranged to rotate the underwater housing is disclosed. A position sensor arranged for each servo motor, which position sensor is arranged to detect an angular position of the underwater housing is also described. A control unit in which a reference angular position of the underwater housing is arranged to be stored during a calibration of the position of the underwater housing and a calibrator of the position of the underwater housings by storing output signals from the position sensors in the control unit during a parallel alignment of propeller shafts in two underwater housings are arranged on the hull of a vessel.

U.S. Pat. No. 7,267,068, which issued to Bradley et al. on Sep. 11, 2007, discloses a method for maneuvering a marine vessel in response to a manually operable control device. A marine vessel is maneuvered by independently rotating first and second marine propulsion devices about their respective steering axes in response to commands received from a manually operable control device, such as a joystick. The marine propulsion devices are aligned with their thrust vectors intersecting at a point on a centerline of the marine vessel and, when no rotational movement is commanded, at the center of gravity of the marine vessel.

U.S. Pat. No. 7,305,928, which issued to Bradley et al. on Dec. 11, 2007, discloses a method for positioning a marine vessel. A vessel positioning system maneuvers a marine vessel in such a way that the vessel maintains its global position and heading in accordance with a desired position and heading selected by the operator of the marine vessel. When used in conjunction with a joystick, the operator of the marine vessel can place the system in a station keeping enabled mode and the system then maintains the desired position obtained upon the initial change in the joystick from an active mode to an inactive mode.

U.S. Pat. No. 7,387,556, which issued to Davis on Jun. 17, 2008, discloses an exhaust system for a marine propulsion device having a driveshaft extending vertically through a bottom portion of a boat hull. An exhaust system for a marine propulsion device directs a flow of exhaust gas from an engine located within the marine vessel, and preferably within a bilge portion of the marine vessel, through a housing which is rotatable and supported below the marine vessel. The exhaust passageway extends through an interface between stationary and rotatable portions of the marine propulsion device, through a cavity formed in the housing, and outwardly through hubs of pusher propellers to conduct the exhaust gas away from the propellers without causing a deleterious condition referred to as ventilation.

U.S. Pat. No. 7,389,165, which issued to Kaji on Jun. 17, 2008, describes an attitude angle control apparatus, attitude angle control method, attitude angle control apparatus control program, and marine vessel navigation control apparatus. The program selects an optimum attitude angle in a short period of time without being affected by disturbances at sea by measuring attitude angles and specific fuel consumption during navigation for any combination of a hull and propeller, create a statistical model based on the measured data, and select an optimum attitude angle on the statistical model. A marine vessel navigation control apparatus includes a control speed navigation controller and a trim angle controller. The trim angle controller includes an evaluated-value calculation module which calculates evaluated values of the trim angle, a storage medium, a statistical model creation module which creates statistical models using the evaluated values stored in the storage medium as an explained variable, and predetermined information including the trim angle as an explanatory variable, and a target trim angle calculation module which calculates a target trim angle based on the statistical model.

The patents described above are hereby expressly incorporated by reference in the description of the present invention.

When the combined thrusts of two or more marine propulsion drives are used to propel a marine vessel, it is beneficial to assure that the propeller shafts of the multiple drive units are aligned with each other and with a line that is generally parallel to the keel line of the marine vessel. By assuring this physical relationship, proper operation of the marine propulsion device can be improved. It would therefore be beneficial if an automatic calibration system could be provided which positions the marine drives in such a way that the improved operation of the marine vessel is achieved and the fuel usage of the marine vessel is reduced.

SUMMARY OF THE INVENTION

A method for calibrating a marine propulsion system, in accordance with a preferred embodiment of the present invention, comprises the steps of monitoring the operation of the marine propulsion system for a first predetermined period of time wherein the marine propulsion system comprises a first drive unit and a second drive unit, determining that the marine propulsion system is operating in a sufficiently consistent manner during the first predetermined period of time to justify a fuel usage comparison, measuring a first fuel usage rate for the marine propulsion system, causing a change of a steering angle in a selected direction for the marine propulsion system, measuring a second fuel usage rate for the marine propulsion system which is subsequent to the first fuel usage rate by a second predetermined period of time, and comparing the first and second fuel usage rates.

A particularly preferred embodiment of the present invention further comprises the step of characterizing the effect of the causing step as improving the fuel usage, degrading the fuel usage, or having a negligible effect on the fuel usage. In response to the effect of the causing step being characterized as improving the fuel usage, a preferred embodiment of the present invention further comprises the step of repeating the steps of measuring the first fuel usage rate, causing the change of a steering angle in the selected direction, measuring the second fuel usage rate, and comparing the first and second fuel usage rates. In a preferred embodiment of the present invention, the repeated comparing step is followed by a repeated characterizing step where the method further characterizes the effect of the causing step as improving, degrading, or having a negligible effect on the fuel usage.

In a preferred embodiment of the present invention, the marine propulsion system comprises a first engine connected in torque transmitting relation with the first drive unit and a second engine connected in torque transmitting relation with the second drive unit. In certain preferred embodiments of the present invention, the first fuel usage rate is the combined fuel usage rate for the first and second engines and the second fuel usage rate is the combined fuel usage rate for the first and second engines at a subsequent time. The first fuel usage rate is measured chronologically before the second fuel usage rate is measured. In preferred embodiments of the present invention, the first drive unit and the second drive unit are supported below the first engine, the second engine and the hull of a marine vessel.

In certain preferred embodiments of the present invention, the change of the steering angle comprises equal changes to the steering angles of both the first drive unit and the second drive unit. These equal changes can be equal in magnitude, but opposite in direction, to result in steering changes for the drive units that are symmetrical with respect to the marine vessel. In certain embodiments of the present invention, the method further comprises the step of repeating the steps of measuring the first fuel usage rate, causing different change of a steering angle in a direction opposite to the selected direction, measuring the second fuel usage rate, and comparing the first and second fuel usage rates in response to the effect of the causing step being characterized as degrading the fuel usage, wherein the different change of a steering angle is determined as a function of a previous change of the steering angle in the selected direction. The method of the present invention, in a preferred embodiment, can further comprise the step of stopping the calibration procedure in response to the characterizing step as having negligible effect on the fuel usage.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 3:
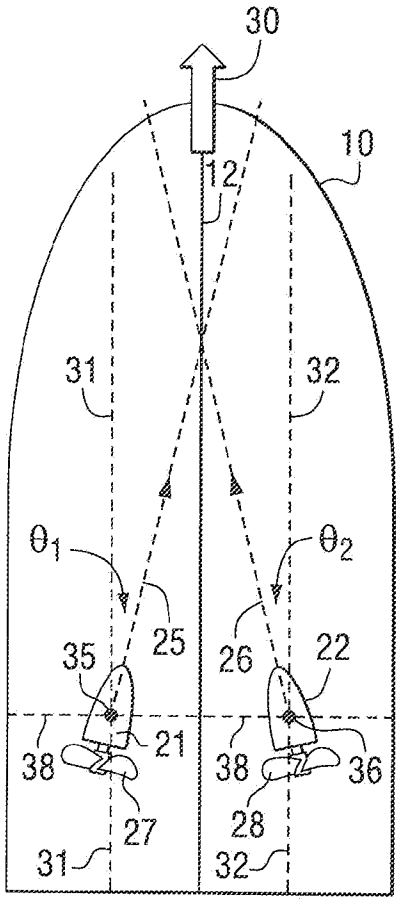
FIG. 3 is generally similar to FIG. 2 but with a further misalignment of the drive units from being parallel with the keel line.

Throughout the description of the preferred embodiment of the present invention, like components will be identified by like reference numerals.

Figure 1:
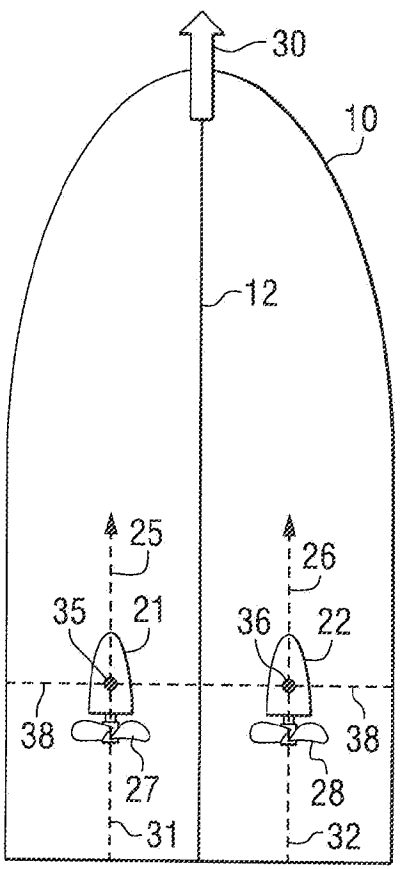
FIG. 1 is a bottom view of a marine vessel with two drive units.

FIG. 1 is a schematic representation of a marine vessel 10 which is generally symmetrical about a keel line 12. In the illustrations of FIGS. 1-4, the views are taken from below the boat. The marine vessel has two drive units, 21 and 22, that are suspended below the hull of the marine vessel 10. As illustrated, the port drive unit 22 and the starboard drive unit 21 are aligned in a generally parallel relation with the keel line 12. The arrows, 25 and 26, are used to represent the direction in which the drive units are pointing and directing their thrusts. In other words, thrust provided by the propellers, 27 and 28, is exerted in a direction represented by arrows 25 and 26, respectively. For purposes of the description of the preferred embodiment of the present invention, each drive unit is illustrated with a single propeller, 27 or 28, but it should be understood that typical applications of these particular types of marine propulsion systems, typically use dual propellers which rotate in opposite directions. However, the number of propellers on each drive unit and the direction of rotation of their respective propellers is not limiting to the various embodiments of the present invention.

With continued reference to FIG. 1, it would normally be expected that an alignment of the drive units as illustrated in FIG. 1, with the thrust arrows, 25 and 26, parallel to the keel line 12, would result in the marine vessel 10 moving in a line represented by the block arrow 30. In a typical alignment of a newly manufactured marine vessel, the alignment is done manually and typically comprises various measurements to place the two drives in a parallel configuration with each other and with the keel line. In some applications, the marine vessel is then driven on a body of water to test the manual alignment to assure that the marine vessel runs in a generally straight line, similar to block arrow 30, which is aligned with the keel line 12. While this manual alignment is intended to result in a straight running of the marine vessel, as represented by block arrow 30, it is recognized that most watercraft can operate in a straight line without necessarily having the drive units be parallel to each other or to the keel line. One of the purposes of the preferred embodiments of the present invention is to correct the situation and align the two drive units with each other and with the keel line 12. Dashed lines 31 and 32 are intended to illustrate lines which are parallel to the keel line 12 and which extend through the driveshafts, 35 and 36, about which the drive units, 21 and 22, rotate, respectively. This rotation about the drive shaft axes is the manner in which a marine propulsion system of this type is steered. While it is apparent that two drive units, 35 and 36, aligned with their directions of thrust, 25 and 26, both aligned parallel with the keel line 12 will result in the marine vessel 12 being propelled in a line parallel to the keel line as represented by block arrow 30, other positions of the drive units which are not parallel to the keel line 12 can also result in a combined thrust that directs the marine vessel in the direction of arrow 30. In the description of the various embodiments of the present invention, it will be assumed that the other variables (e.g. weight distribution, slight asymmetrical hull structure) that affect the direction in which a marine vessel moves are appropriately balanced such that the direction of movement is a result of the combined thrusts of the two drives, 21 and 22.

When a marine vessel such as that illustrated in FIG. 1 is constructed, the drive units, 21 and 22, are attached to the hull of the boat in such a way that when a steering wheel of the marine vessel is aligned with a straight ahead position, the drive units are positioned such that the resulting thrusts, 25 and 26, are parallel to the keel line 12 of the marine vessel 10. That is the goal of the manual assembly process. However, that goal is not always achieved. It is possible that offsetting misalignments for the drive units can cooperatively result in the marine vessel 10 traveling in a straight line parallel to its keel line 12 even though the drive units are not individually aligned with lines, 31 and 32, that are parallel to the keel line 12. This situation is represented in FIG. 2.

Figure 2:
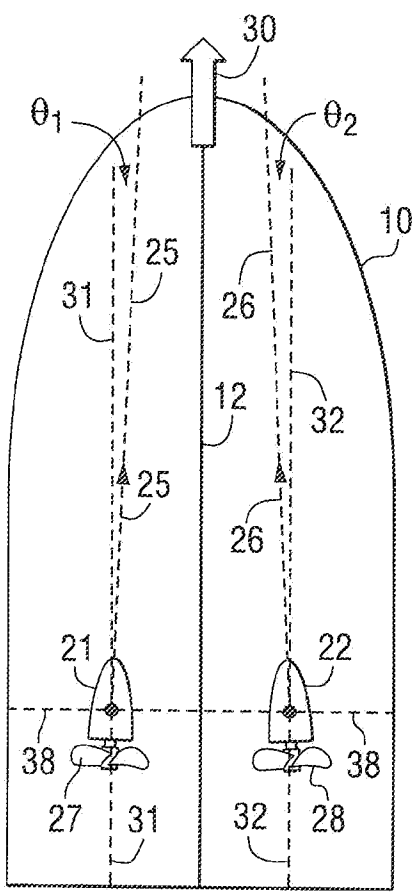
FIG. 2 is a bottom view of the marine vessel of FIG. 1, but with an offset in the steering alignments from a perfectly aligned pair of drive units that are parallel to the keel line of the marine vessel.

In FIG. 2, the two drive units, 21 and 22, are shown misaligned such that their individual thrusts, 25 and 26, extend in directions that differ from dashed lines 31 and 32 by the angles identified as $\theta_1$ and $\theta_2$ in FIG. 2. In a situation like that represented in FIG. 2, the resulting thrust from the two drive units combine such that their component thrusts in directions parallel to dashed line 38 are vectors which are equal in magnitude and opposite in direction. As a result, a resultant thrust 30 is equal to the vectorial sum of the individual components of thrust which are parallel to dashed lines 31 and 32. Although the resulting thrust parallel to the keel line 12 is not equal to the sum of the two individual thrusts of the drive units, the direction of that resultant thrust is parallel to the keel line 12 and, as a result, the marine vessel 10 will travel in a generally straight line (i.e. block arrow 30).

FIG. 3 shows a situation which, like that represented in FIG. 2, involves thrust directions, 25 and 26, which cooperatively balance each other, but unlike the illustration in FIG. 2, are illustrated to show a much more severe magnitude of angles $\theta_1$ and $\theta_2$ that intentionally exaggerate the degree by which the thrust lines, 25 and 26, differ from the lines, 31 and 32, that are parallel to the keel line 12. It can be realized that, even though the thrusts, 25 and 26, will balance to cancel their individual components along dashed line 38 and result in a direction of travel of the marine vessel 10 in a generally straight line as represented by block arrow 30, the efficiency in the operation of a marine vessel 10 with the situation illustrated in FIG. 3 is much less than that shown in FIG. 1 or 2. As an extreme example, as the magnitudes of $\theta_1$ and $\theta_2$ increase while maintaining their equality, the efficiency is reduced significantly as the magnitudes of $\theta_1$ and $\theta_2$ approach 90 degrees. Under that extreme situation, no forward travel (i.e. an efficiency of zero) would be experienced by the marine vessel 10 and the opposing thrusts along dashed line 38 would cancel each other. Essentially, no movement of the marine vessel 10 would occur. Although that is an extreme example of a misalignment of the drive units, 21 and 22, other misalignments of a lesser magnitude can adversely affect the efficiency of the marine propulsion system.

Those skilled in the art of marine propulsion systems are aware of the manner in which engine control modules (ECM's) are used to control the operation of the engines associated with the marine drive units, 21 and 22. The engine control modules comprise microprocessors that receive various types of input data from the engines and provide controlled outputs that change the operation of the engines. Similarly, although an operator of a marine vessel has the ultimate control of its direction of movement through the use of a steering wheel, many types of marine propulsion systems receive signals from the steering wheel and effectuate the desired angle of turn by activating an actuator which causes the marine drive units to rotate about their driveshafts, 35 and 36.

In a preferred embodiment of the present invention, the calibration procedure is permitted when it is determined that the marine vessel 10 is operating in a consistent manner for a preselected period of time. In a preferred embodiment of the present invention, the operation in a consistent manner requires that the speed of the marine vessel 10 is not changed significantly and the steering system of the marine vessel is not used to demand a significant angle of turn for a preselected period of time. While preferred embodiments of the present invention do not necessarily require that absolutely no degree of turn occurs and absolutely no change in speed is demanded for the preselected period of time, this is the preferred level of stability, or consistency, and is likely to result in increased accuracy in the overall calibration procedure. When consistency of operation is detected and verified over a first predetermined period of time, a comparison of fuel usages at two chronologically separated instances is justified and can be used to calibrate the steering system. In a preferred embodiment of the present invention, a fuel usage represents the amount of fuel used over a period of time. This fuel usage can be determined in several ways. One example is the actual fuel consumed during a preselected period of elapsed time. This usage can be tracked by adding the individual injections of fuel. Another is a mathematical representation based on a calculated fuel usage magnitude. In addition, a calculation of the quantity of fuel used for each combustion "event", in addition to the known engine speed, can be used by the microprocessor of the engine control module to determine the fuel usage, or fueling rate, which is then determined in grams per second for each engine or in other suitable units. The fuel usage is obtained at two sequential instances. In a preferred embodiment of the present invention, the fuel usage determined at each instance is a sum of the fuel usage for both engines of a dual drive marine vessel. If more than two engines are used, the fuel usage would be the summation of all of the engines. In order to determine whether the steering angle is optimal, a known incremental change in steering angle is added to the existing steering angle and two chronologically separated measurements of fuel usage are taken to characterize the effect of the steering change. The characterization step can then identify the results of the change as improving the fuel usage, degrading the fuel usage, or having a negligible effect on the fuel usage. Beyond the first measurement of any change in fuel usage, variations in the various preferred embodiments of the present invention include repeated measurements in response to improved fuel usage, stopping the measurements in response to a negligible effect on fuel usage, or reversing the direction of the change in response to a degradation of the fuel usage. Those variations in preferred embodiments of the present invention can be tailored in various ways to optimize the calibration procedure.

For clarity and simplicity, the preferred embodiments of the present invention have been described primarily in terms of two marine propulsion units. However, it should be understood that alternative embodiments of the present invention can be applied to marine propulsion systems with other numbers of drive units. As an example, alternative embodiments of the present invention can be used in conjunction with a marine propulsion system having five drive units. To explain this embodiment, it is necessary to identify, from the outer port drive to the outer starboard drive, in order, five marine drive units identified as A, B, C (along the keel), D, and E. Drives A and E are the outer port and starboard drives, respectively. Drive C is in the center of the five drive units. Drive B is between drives A and C and drive D is between drives C and E. The basic procedures of the preferred embodiments of the present invention have been described above and will not be repeated in their entirety. The steps described above that are used in executing the preferred embodiments of the methods of the present invention would be applied to the drive units in selected pairs. As an example, drive units A and E could be calibrated with drives B, C, and D placed in a known position, such as trimmed out of the water or trimmed in some identical manner and steered to be generally aligned along axes which are parallel to the keel. Then, the steps of the method of the present invention can be performed on drive units B and D with the other drive units A, C, and E trimmed in an identical manner and steered to be parallel with axes that are, in turn, parallel with the keel. The basic steps of the preferred embodiments of the present invention can be performed on different pairs of drive units. Although the preferred embodiments of the present invention have been primarily described in terms of marine propulsion systems with two marine drive units, it should be understood that this is not limiting in some of the alternative embodiments of the present invention.

Figure 4:
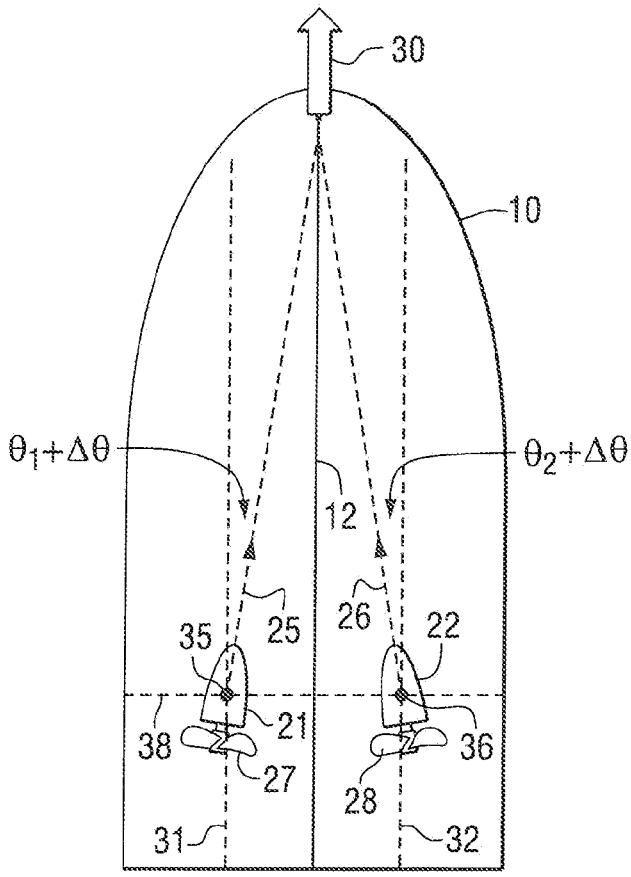
FIG. 4 shows a step in the calibration process that adds a known offset to the steering angles of the two drive units.

With reference to FIG. 4, the steering angles for the two drives, 21 and 22, have been changed symmetrically by adding an offset of $\Delta\theta$ to each steering angle in opposite directions to maintain symmetry. It should be understood that the positive magnitude of steering for the starboard drive unit is measured in an opposite direction to the steering angle for the port drive unit. After the offset is added to the steering angle, a subsequent fuel usage is measured or otherwise determined. By comparing the fuel usage measured before the steering change illustrated in FIG. 4 and then measuring the fuel usage after the steering change, the effect of the steering change can be characterized as improving the fuel usage, degrading the fuel usage, or having a negligible effect on the fuel usage. By repeating this process, an optimal steering angle can be developed.

With continued reference to FIG. 4, it is assumed that the direction of travel of the marine vessel 10 is straight ahead, as represented by block arrow 30, both before and after the incremental change of the steering angle which, as described above, is equal to $\Delta\theta$. In addition, as additional incremental and equal steering angle changes are made, the marine vessel 10 is assumed to continue to travel in a generally straight line which is parallel to the keel line 12.

Figure 5:
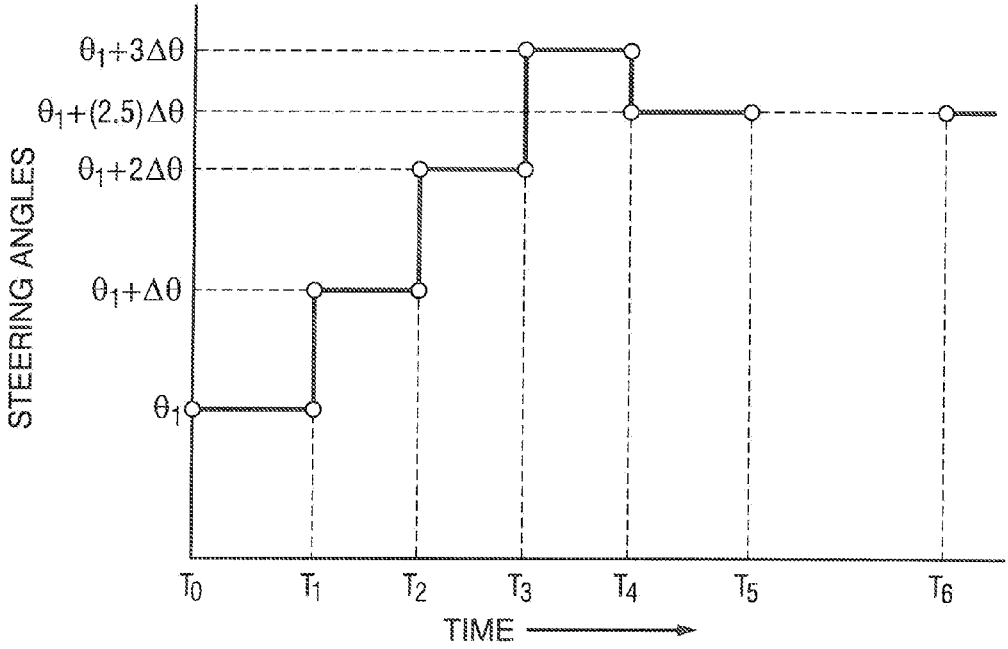
FIG. 5 shows a sequence of steps performed in accordance with a preferred embodiment of the present invention.

FIG. 5 is a graphical representation of the steering angles for a hypothetical calibration operation illustrated as a function of time. The vertical axis in FIG. 5 shows the starboard drive steering angle. It should be understood that the starboard steering angle $\theta_1$ is assumed to be generally equal to the port steering angle $\theta_2$ because of the symmetrical nature of the procedures that precede the calibration process of the preferred embodiments of the present invention. However, for purposes of simplicity, only the starboard angle is shown in FIG. 5.

With continued reference to FIG. 5, the initial steering angle is equal to $\theta_1$ and exists between time $T_0$ and $T_1$. At $T_1$, the offset of $\Delta\theta$ is added to the steering angle and it then becomes equal to $\theta_1+\Delta\theta$. Subsequent to time $T_1$, a second fuel usage magnitude is obtained and compared to a fuel usage magnitude that was obtained prior to $T_1$ when the steering angle was changed. The comparison and characterization described above occurs between time $T_1$ and time $T_2$. In the illustration of FIG. 5, it is assumed that the comparison and characterization made between time $T_1$ and time $T_2$ indicated that there was an improvement in the fuel usage as a result of adding the offset $\Delta\theta$ to the initial steering angle $\theta_1$. At time $T_2$, the same offset was added again to result in a steering angle of $\theta_1+2\Delta\theta$. The hypothetical graph shown in FIG. 5 assumes that a fuel usage measurement made between time $T_2$ and time $T_3$ indicates an improvement in fuel usage. As a result, another steering offset of $\Delta\theta$ was performed at time $T_3$ in order to achieve a cumulative steering angle of $\theta_1+3\Delta\theta$ at time $T_3$. Illustrated by the line in FIG. 5, a fuel usage comparison made between time $T_3$ and time $T_4$ indicated that the effect of the steering angle change done at time $T_3$ had a degrading effect. In other words, the fuel efficiency became worse as a result of changing the steering angles to $\theta_1+3\Delta\theta$. As a result, the steering angle was changed in the opposite direction by half of the previous offset magnitudes. In other words, an offset of 0.5 $\Delta\theta$ was made in the opposite direction in order to cause the steering angles to be equal to $\theta_1+2.5\Delta\theta$. This occurred at time $T_4$. As a result of the subsequent fuel usage measurement, no further changes were made and the steering angle remained constant through time $T_5$. Although the fuel usage magnitudes are not illustrated in FIG. 5, the constancy of the steering angle through time $T_5$ is indicative of the fact that any change in fuel usage that was measured between time $T_4$ and time $T_5$ was negligible and no further changes in either direction were performed. The period between time $T_5$ and time $T_6$ indicates that no further changes in steering angle were made and no further fuel usage measurements were made until time $T_6$ at which time the process illustrated between time $T_0$ and $T_5$ would be repeated with the number of steps and incremental steering changes being dependent on the results obtained from measuring the fuel usages. The length of time between time $T_5$ and time $T_6$ could be days or weeks in length. The time between calibrations is not limiting to the various embodiments of the present invention. In addition, the fact that the change in the steering angle at time $T_4$ was half the amount that occurred at times $T_1$, $T_2$, and $T_3$ is not limiting to the present invention and could have been determined as a function other than 50%. However, most preferred embodiments of the present invention would utilize a reversal in direction and some reduction in magnitude when the change in fuel usage resulting from the steering angle change has been characterized as one that degrades the fuel usage rather than improves the fuel usage or has a negligible effect on it.

Figure 6:
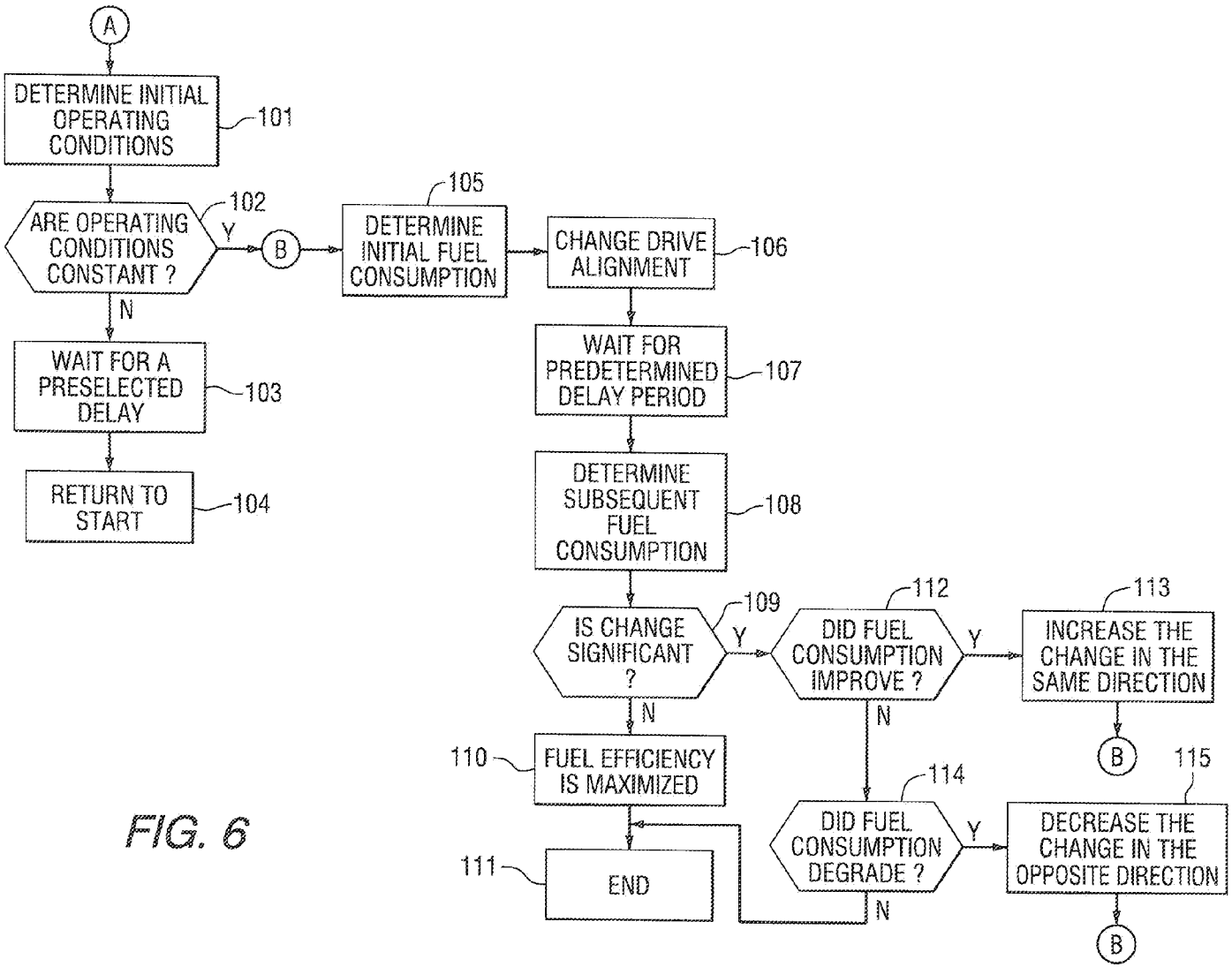
FIG. 6 is a simplified basic flowchart illustrating one of the preferred embodiments of the present invention.
Figure 7:
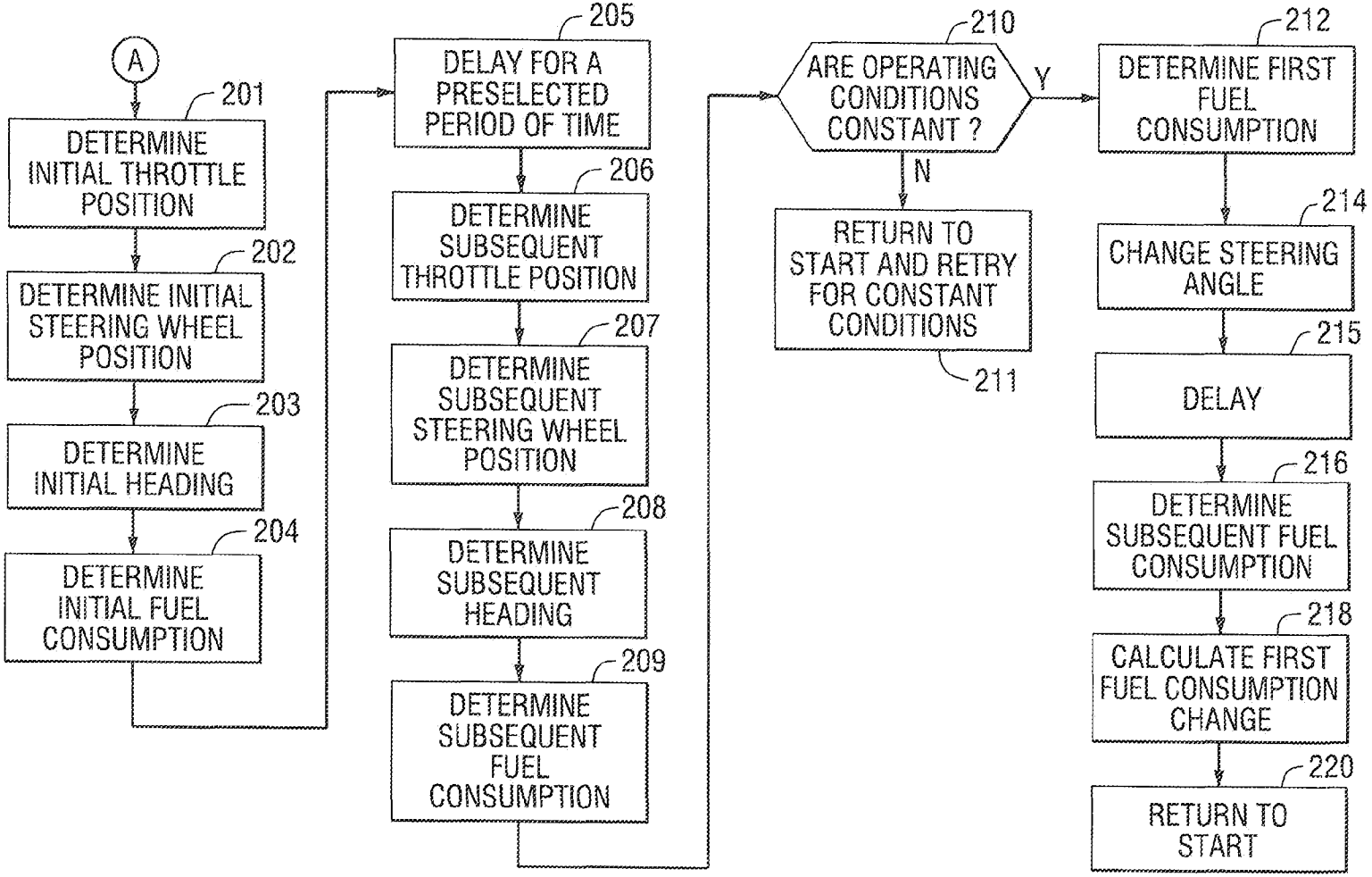
FIG. 7 illustrates another basic flowchart showing an alternative embodiment of the present invention.

FIGS. 6 and 7 are simplified flowcharts which hypothetically illustrate the type of software that can be used to implement the calibration procedures of the preferred embodiments of the present invention. In FIG. 6, beginning at point A, a determination is made of the initial operating conditions of the marine vessel at functional step 101. This determination is intended to assure that the marine vessel is operating in a sufficiently consistent manner to justify a valid fuel usage comparison. As will be described in greater detail below, the individual steps in functional block 101 would determine that the changes in throttle position and steering positions, if any, are relatively minor and would not be expected to significantly affect the fuel consumption. At functional block 102, this determination is made. If the operation is too erratic, functional block 103 delays for a period of time and the program again returns to point A, as described at functional block 104, to again determine the initial operating conditions and decide if they are consistent. If the conditions are constant, or consistent within a preselected range of change, the program proceeds to step B to determine an initial fuel consumption value at functional block 105. It then changes the drive alignment as described above in relation to times $T_1$, $T_2$, $T_3$, and $T_4$. This is accomplished at functional block 106 and is followed by a predetermined delay period at functional block 107. A subsequent fuel consumption magnitude is taken at functional block 108. A determination is made at functional block 109 if the change in fuel consumption is significant or, alternatively, if it is too small to warrant continuation in the calibration process. If it is significant, at functional block 110 it is determined that the fuel efficiency has been maximized and the program ends at functional block 111. If, on the other hand, the change has been determined to be significant, a determination is made to see if the fuel consumption improved or degraded. This is done at functional block 112. If it did improve, the steering angle is increased by the same amount and in the same direction. Then the program proceeds to point B and functional block 105. If, on the other hand, the fuel consumption did not improve, it is determined whether or not it was degraded at functional block 114. If the answer to this question is no, the program ends because the fuel consumption neither improved nor was degraded and this is considered to be the same condition as if the change was initially determined to be insignificant at functional block 109. If the fuel consumption was degraded, functional block 115 decreases the magnitude of the change and applies it in the opposite direction when it returns to point B to execute functional block 105. It should be understood that the flowchart in FIG. 6 is highly simplified and intended to simply show the types of steps that would be used in a basic program to perform the functions of the present invention. It should be understood, however, that the determinations made to implement the preferred embodiments of the present invention need not be identical or highly similar to the steps illustrated in the flowchart of FIG. 6. Many different techniques can be used to perform the steps as described above and as will be described in further detail below.

FIG. 7 is a simplified flowchart that is intended to show some of the detailed measurements and determinations made by the present invention in its determination of the consistency of operation of the marine propulsion system. Beginning at step A, the program determines the initial throttle position at functional block 201, determines the initial steering wheel position at functional block 202, determines an initial heading at functional block 203 and determines an initial fuel consumption at functional block 204. In addition to these initial measurements and observations, it should be understood that other parameters can be used to determine whether or not the marine propulsions system is operating consistently and in a sufficiently constant manner to allow for a comparison of fuel consumption to be made. After these observations, the program delays for a period of time at functional block 205 before subsequent throttle position, steering wheel position, heading, and fuel consumption measurements are made as indicated at functional blocks 206, 207, 208, and 209. When functional block 209 is completed, the program cam make a determination that the throttle position, steering wheel position, heading, and fuel consumption are sufficiently constant to allow the program to make the steering change so that the fuel consumptions can be compared. The consistency of operation is analyzed at functional block 210. If the conditions are not sufficiently constant, the program returns to point A and begins again. This is identified as functional block 211. It should be understood that the use of functional blocks 201-204 and their comparison to functional blocks 206-209 are hypothetical and exemplary. Although it is likely that these particular parameters would represent a logical and feasible way to determine the consistency of operation of the marine propulsion system, other techniques can be used to make this determination. The comparison of functional blocks 201 and 206 allow the engine control module to determine the consistency of the throttle position, the comparisons of functional blocks 202 and 207 allow the ECM to monitor the consistency of the steering wheel position, the comparison of functional blocks 203 and 208 allow the headings to be compared, and the comparison of functional blocks 204 and 209 monitor the consistency of fuel consumption, during a period when no major changes are occurring, in order to determine whether or not something else may be causing a variation in fuel consumption. This would indicate that it might not be a good time to perform the steering calibration procedures.

With continued reference to FIG. 7, after the operating conditions have been determined to be consistent at functional block 210, the first fuel consumption value is determined at functional block 212. Then a steering angle change is made at functional block 214 followed by a preselected delay at functional block 215. Following this, a subsequent fuel consumption value is determined at functional block 216 and the change between the fuel consumption measurement made at functional block 212 and the one made at functional block 216 is made at functional block 218. At functional block 220, the program returns to the start position. Not shown in FIG. 7 is the comparison of the two fuel consumption magnitudes to determine the characterization described above. However, it should be understood that this characterization could be made between functional blocks 218 and 220 or it could be done as a portion of functional block 218. Furthermore, the determination made between an improving effect, a degrading effect, or a negligible effect can alternatively be made based on a comparison of the percentage change to a table of percentage ranges. Alternatively, the characterization step can be made in combination with the calculation of the fuel consumption change at functional block 218 where the differences between the first fuel consumption determination and the subsequent fuel consumption determination, at functional blocks 212 and 216, are made. This is a logical place for the characterization to be made since, at that point in time, the first and subsequent fuel consumption determinations are complete and the calculation is made to determine the change in fuel consumption resulting from the change in the steering angle that was made at functional block 214 prior to the delay at functional block 215.

It should be understood that the flowcharts of FIGS. 6 and 7 are hypothetical in nature and highly simplified in order to show the basic functions performed by the engine control module. The flowcharts are not intended to be restrictive in any manner or to limit the various ways that the information can be derived or determined and then subsequently used. The fuel usage, or fuel consumption, that is used in the various embodiments of the present invention to determine whether or not the steering angle changes have improved, degraded, or had no effect on the efficiency of operation of the marine propulsion system is typically measured in units of fuel quantity per unit of time. The various parameters used in the preferred embodiments of the present invention can be obtained through the use of a global positioning system (GPS), a compass, and other devices which provide various information parameters, the steering angles at which the drive units are positioned, and steering wheel position. The engine information can include the RPM and throttle position. In addition, the speed (miles per hour) of the marine vessel can be monitored to determine the consistency of operation. The fuel usage can be determined in several ways. In some fuel injected systems, the actual fueling rate (e.g. cubic centimeters per minute) can be measured over a suitable period of time. Alternatively, certain theoretical fueling rates can be determined based on other inputs, such as engine speed and load. Regarding the measurements of consistency of operation, this same fuel usage magnitude can be monitored prior to the actual calibration procedure to assure that the system is running in a relatively constant and consistent manner. Of course, the consistency of operation would also normally be determined as a function of steering wheel position and throttle handle position in addition to actual measured marine vessel velocity.

It should be understood that variations of the preferred embodiments of the present invention can also be used to determine the proper symmetry of the drive unit positions. For example, with reference to FIGS. 2 and 3, the magnitudes of $\theta_1$ may not actually equal the magnitudes of $\theta_2$ as is expected in most cases. As described above, the operation of the marine vessel 10 along a straight line that is generally parallel to the keel line 12 is a good measure of the proper manually calibrated positions of the two drive units even though $\theta_1$ may not equal $\theta_2$. However, variations of the present invention can be used to make minor changes to either $\theta_1$ or $\theta_2$ to determine the effect of these minor changes on the operation of the marine vessel along the line that is parallel to the keel line 12. While not a requirement or necessary component to the method of the present invention, in its preferred embodiments, the individual changes in the steering angles of the drive units, 21 and 22, can be used to periodically ascertain that their positions are generally equal.

Although the present invention has been described with particular specificity and illustrated to show preferred embodiments, it should be understood that alternative embodiments are also within its scope.

We claim:

1. A method for calibrating a marine propulsion system, comprising the steps of monitoring the operation of said marine propulsion system for a first predetermined period of time, wherein said marine propulsion system comprises a first drive unit and a second drive unit;

determining that said marine propulsion system is operating in a sufficiently consistent manner during said first predetermined period of time to justify a fuel usage comparison;

measuring a first fuel usage rate for said marine propulsion system;

causing a change of a steering angle in a selected direction for said marine propulsion system;

measuring a second fuel usage rate for said marine propulsion system which is subsequent to said first fuel usage rate by a second predetermined period of time; and comparing said first and second fuel usage rates.

2. The method of claim 1, further comprising the step of:

characterizing the effect of said causing step as improving said fuel usage, degrading said fuel usage, or having negligible effect on said fuel usage.

3. The method of claim 1, further comprising the step of repeating said steps of measuring said first fuel usage rate, causing said change of a steering angle in said selected direction, measuring said second fuel usage rate, and comparing said first and second fuel usage rates in response to said effect of said causing step being characterized as improving said fuel usage.

4. The method of claim 1, wherein:

said marine propulsion system comprises a first engine connected in torque transmitting relation with said first drive unit and a second engine connected in torque transmitting relation with said second drive unit.

5. The method of claim 4, wherein:

said first fuel usage rate is the combined fuel usage rate for said first and second engines;

said second fuel usage rate is the combined fuel usage rate for said first and second engines; and said first fuel usage rate is measured chronologically before said second fuel usage rate is measured.

6. The method of claim 4, wherein:

said first drive unit and said second drive unit are supported below said first engine, said second engine, and a hull of a marine vessel.

7. The method of claim 1, wherein:

said change of said steering angle comprises equal changes to the steering angles of both said first drive unit and said second drive unit.

8. The method of claim 1, further comprising the step of:

repeating said steps of measuring said first fuel usage rate, causing a different change of a steering angle in a direction opposite to said selected direction, measuring said second fuel usage rate, and comparing said first and second fuel usage rates in response to said effect of said causing step being characterized as degrading said fuel usage, wherein said different change of a steering angle is determined as a function of a previous change of said steering angle in said selected direction.

9. The method of claim 1, further comprising the step of stopping said calibration procedure in response to said characterizing step as having a negligible effect on said fuel usage.

10. A method for calibrating a marine propulsion system, comprising the steps of:

monitoring the operation of said marine propulsion system for a first predetermined period of time, wherein said marine propulsion system comprises a first drive unit and a second drive unit;

determining that said marine propulsion system is operating in a sufficiently consistent manner during said first predetermined period of time to justify a fuel usage comparison;

measuring a first fuel usage rate for said marine propulsion system;

causing a change of a steering angle in a selected direction for said marine propulsion system;

measuring a second fuel usage rate for said marine propulsion system which is subsequent to said first fuel usage rate by a second predetermined period of time, said marine propulsion system comprising a first engine connected in torque transmitting relation with said first drive unit and a second engine connected in torque transmitting relation with said second drive unit, said change of said steering angle comprising equal changes to the steering angles of both said first drive unit and said second drive unit; and comparing said first and second fuel usage rates.

11. The method of claim 10, wherein:

said first drive unit and said second drive unit are supported below said first engine, said second engine, and a hull of a marine vessel.

12. The method of claim 11, further comprising the step of:

characterizing the effect of said causing step as improving said fuel usage, degrading said fuel usage, or having negligible effect on said fuel usage.

13. The method of claim 12, wherein:

said first fuel usage rate is the combined fuel usage rate for said first and second engines;

said second fuel usage rate is the combined fuel usage rate for said first and second engines; and said first fuel usage rate is measured chronologically before said second fuel usage rate is measured.

14. The method of claim 13, further comprising the step of:

repeating said steps of measuring said first fuel usage rate, causing said change of a steering angle in said selected direction, measuring said second fuel usage rate, and comparing said first and second fuel usage rates in response to said effect of said causing step being characterized as improving said fuel usage.

15. The method of claim 13, further comprising the step of repeating said steps of measuring said first fuel usage rate, causing a different change of a steering angle in a direction opposite to said selected direction, measuring said second fuel usage rate, and comparing said first and second fuel usage rates in response to said effect of said causing step being characterized as degrading said fuel usage, wherein said different change of a steering angle is determined as a function of a previous change of said steering angle in said selected direction.

16. The method of claim 13, further comprising the step of stopping said calibration procedure in response to a determination by said characterizing step of said as having a negligible effect on said fuel usage.

17. A method for calibrating a marine propulsion system, comprising the steps of:

monitoring the operation of said marine propulsion system for a first predetermined period of time, wherein said marine propulsion system comprises a first drive unit and a second drive unit;

determining that said marine propulsion system is operating in a sufficiently consistent manner during said first predetermined period of time to justify a fuel usage comparison;

measuring a first fuel usage rate for said marine propulsion system;

causing a change of a steering angle in a selected direction for said marine propulsion system;

measuring a second fuel usage rate for said marine propulsion system which is subsequent to said first fuel usage rate by a second predetermined period of time;

comparing said first and second fuel usage rates, said marine propulsion system comprises a first engine connected in torque transmitting relation with said first drive unit and a second engine connected in torque transmitting relation with said second drive unit, said first fuel usage rate being the combined fuel usage rate for said first and second engines, said second fuel usage rate being the combined fuel usage rate for said first and second engines, said first fuel usage rate being measured chronologically before said second fuel usage rate is measured, said first drive unit and said second drive unit being supported below said first engine, said second engine, and a hull of a marine vessel;

characterizing the effect of said causing step as improving said fuel usage, degrading said fuel usage, or having negligible effect on said fuel usage; and stopping said calibration procedure in response to said characterizing step as having a negligible effect on said fuel usage.

18. The method of claim 17, further comprising the step of:

repeating said steps of measuring said first fuel usage rate, causing said change of a steering angle in said selected direction, measuring said second fuel usage rate, and comparing said first and second fuel usage rates in response to said effect of said causing step being characterized as improving said fuel usage.

19. The method of claim 17, wherein:

said change of said steering angle comprises equal changes to the steering angles of both said first drive unit and said second drive unit.

20. The method of claim 17, further comprising the step of:

repeating said steps of measuring said first fuel usage rate, causing a different change of a steering angle in a direction opposite to said selected direction, measuring said second fuel usage rate, and comparing said first and second fuel usage rates in response to said effect of said causing step being characterized as degrading said fuel usage, wherein said different change of a steering angle is determined as a function of a previous change of said steering angle in said selected direction.

* * * * *